US006091331A

United States Patent [19]

Toft et al.

[11] Patent Number: 6,091,331

[45] Date of Patent: Jul. 18, 2000

[54] EMERGENCY WORKER AND FIREMAN'S DUAL EMERGENCY WARNING SYSTEM

[75] Inventors: Carl Toft, La Puente; David V. Haston, Glendora; Carl E. Schaefer, Tustin; Duane E. Decker, Upland, all of Calif.

[73] Assignee: Bacou USA Safety, Inc., Smithfield, R.I.

[21] Appl. No.: 09/395,484

[22] Filed: Sep. 14, 1999

[51] Int. Cl.[7] ..... G08B 21/00

[52] U.S. Cl. ..... 340/539; 340/540; 340/321; 340/531; 340/532; 340/586

[58] Field of Search ..... 340/539, 540, 340/692, 321, 573, 603, 605, 328, 531, 532, 533, 586, 573.1

[56] References Cited

U.S. PATENT DOCUMENTS 4,714,077 12/1987 Lambert ..... 128/202.27
5,317,305 5/1994 Campman .
5,331,955 7/1994 Lewis ..... 128/200.24
5,420,828 5/1995 Geiger ..... 367/131
5,492,110 2/1996 Lenz et al. ..... 128/202.22
5,757,273 5/1998 Crandall et al. ..... 340/573
5,781,118 7/1998 Wise et al. .
5,990,793 11/1999 Bieback ..... 340/537.1
5,991,795 11/1999 Howard et al. ..... 709/201

*Primary Examiner*—Daniel J. Wu
*Assistant Examiner*—Hung Nguyen
*Attorney, Agent, or Firm*—George F. Bethel

[57] ABSTRACT

A self-contained breathing apparatus (SCBA) with a personal alert safety system (PASS) having a tank of breathing gas serving a first stage regulator connected to a mask having a demand regulator. A PASS is provided with a first audio alarm within the PASS and a circuit in the PASS which senses movement of a user of the SCBA. The PASS sounds an audio alarm after a pre-established time of non-movement of a user. A remote personal safety system (R-PASS) is attached to a location remote from the PASS, and a communication link connects the PASS to the R-PASS for sounding the audio alarm at the remote location.

21 Claims, 9 Drawing Sheets

16
12
10
14
14
18
18
20
26
86
82
28
22
24
86
60
80
24
46
44
72
64
70
62
30
52
54
50
30
48
32
42
40
36
34

EMERGENCY WORKER AND FIREMAN'S DUAL EMERGENCY WARNING SYSTEM

BACKGROUND OF THE INVENTION AND PRIOR ART

1. Field of the Invention

The field of this invention lies within the art of safety equipment for firemen and emergency workers in hazardous environments. It specifically relates to those types of equipment which are used with self-contained breathing apparatus and/or other life support systems within hazardous environments. Such life support systems include tanks of breathing gas with regulators to regulate gas into a mask. More particularly, it relates to those devices included with such equipment referred to as personal alert safety systems. Such personal alert safety systems are known to provide warnings when a worker could possibly be in a dangerously hazardous condition.

2. Description of the Prior Art

The prior art with regard to emergency and hazardous environment safety equipment has evolved from the necessity to protect firemen and emergency workers in various hazardous environments. During the development of this equipment, the utilization of self-contained breathing apparatus was utilized as well as utilization of various types of support equipment in the form of air being pumped to an emergency worker. However, firemen and emergency workers primarily rely upon self-contained breathing apparatus.

Such self-contained breathing apparatus incorporates the utilization of a pressurized tank of breathing gas. The pressurized tank of gas is mounted on a user's back generally in the form of a backpack. The backpack is strapped to a user with shoulder straps and a waist harness or a waist belt.

In order to allow the emergency worker or fireman to breath, a face mask is utilized having a lens. The face mask is fitted snugly on the face and an opening is provided through the face mask for supplying breathing gas to a nose cup or oral nasal elastomeric mask within the mask. The oral nasal mask or nose cup is supplied by air from the tank through a demand regulator. The demand regulator is mounted in the mask opening and accommodates the worker's or fireman's requirements for breathing gas.

Intermediate pressure to the demand regulator is provided by an air hose connected to a first stage regulator that is mounted on the tank. The first stage regulator is generally mounted on the tank and provided with a valve this allows the flow of gas from the tank through the first stage regulator which regulates the tank pressure down to an intermediate pressure for utilization by the demand regulator.

Due to hazardous conditions such as smoke and gas, it has been common for firemen and hazardous safety workers to utilize a warning device when they are in a compromised safety situation. Oftentimes, such compromises to safety can be attributable to gas inhalation or some type of physical problem. In such cases, the worker or fireman is oftentimes immobilized or for that matter passed out.

In order to detect immobilization or passing out of a fireman or worker, a device referred to as a personal alert safety system (PASS) is utilized. The PASS specifically monitors movement of the safety worker or fireman to assure that the fireman or safety worker is moving and not passed out or immobilized. In order to do this, a motion detector is utilized. The motion detector can often be a motion switch such that when there is no movement upon the part of the worker, the switch provides a signal to actuate an alert or alarm. Such alert or alarm can be either a loud alarm or a signal transmitted to a remote location.

PASS devices have been utilized by workers and firemen mounted on the front of their equipment. One of the problems associated with a frontal mounting is the fact that when the worker is immobilized or falls on the equipment in a passed out condition, the sound can not be heard because it is muffled.

This invention overcomes the foregoing deficiency by allowing a second unit on the worker's or firemen's back to make a sound through the alert system with either an alarm signal or a transmitted signal of any desirable type. Thus, when the user is in a prone position and covering the alarm of the PASS, the second alarm on the back can be audible and well heard.

SUMMARY OF THE INVENTION

In summation, this invention comprises a personal alert safety system (PASS) for a fireman or hazardous environment worker utilizing a self-contained breathing apparatus. It incorporates a first alarm system with appropriate logic and operating systems with a second alert system mounted on the user's back in order to allow for multiple sounds to be emitted to avoid one being muffled when a user is lying prone on one portion of his body or the other which would occlude or cover the alarm from being audibly distinguishable.

More particularly, the invention incorporates a PASS for a user of self-contained breathing apparatus. The self-contained breathing apparatus has the normal pressurized tank of breathing gas mounted on a backpack with a first stage regulator. Gas from the first stage regulator is connected to the user for breathing through a demand regulator connected to the user's mask.

Associated with the intermediate pressure from the first stage regulator to the second stage or demand regulator is the PASS. The PASS is mounted in a manner such that it is automatically actuated upon pressurization of the system. This causes a response from the PASS to begin the function of monitoring the condition of the fireman or hazardous environment worker.

The monitoring by the PASS is through the use of a motion switch which can be a mercury type switch having a detector for connection to a circuit to determine when motion has stopped. The PASS incorporates a plurality of warning and actuation levels in order to accommodate slow movement or restricted movement to avoid an unwarranted alarm.

A remote PASS enunciator is connected to the PASS. The connection is through a hard wired connection to the user's back. However, the connection can be by radio frequency or other wireless signals, fiber optics or other communication to the remote PASS enunciator. The remote PASS enunciator is provided with a second alarm system in order to cause an alarm or alert to sound in tandem with the PASS mounted on the front of the worker's or firemen's chest. Accordingly, when one alarm is muffled by a fireman or downed worker, the second alarm will be heard in a more audible manner inasmuch as it is mounted in a position that is not muffled when the first one is muffled or covered.

As a consequence, this invention is a significant step in PASS technology to allow for multiple alerts in the eventuality one alarm or the other is muffled or covered.

DESCRIPTION OF THE PREFERRED EMBODIMENTS

Figure 1:
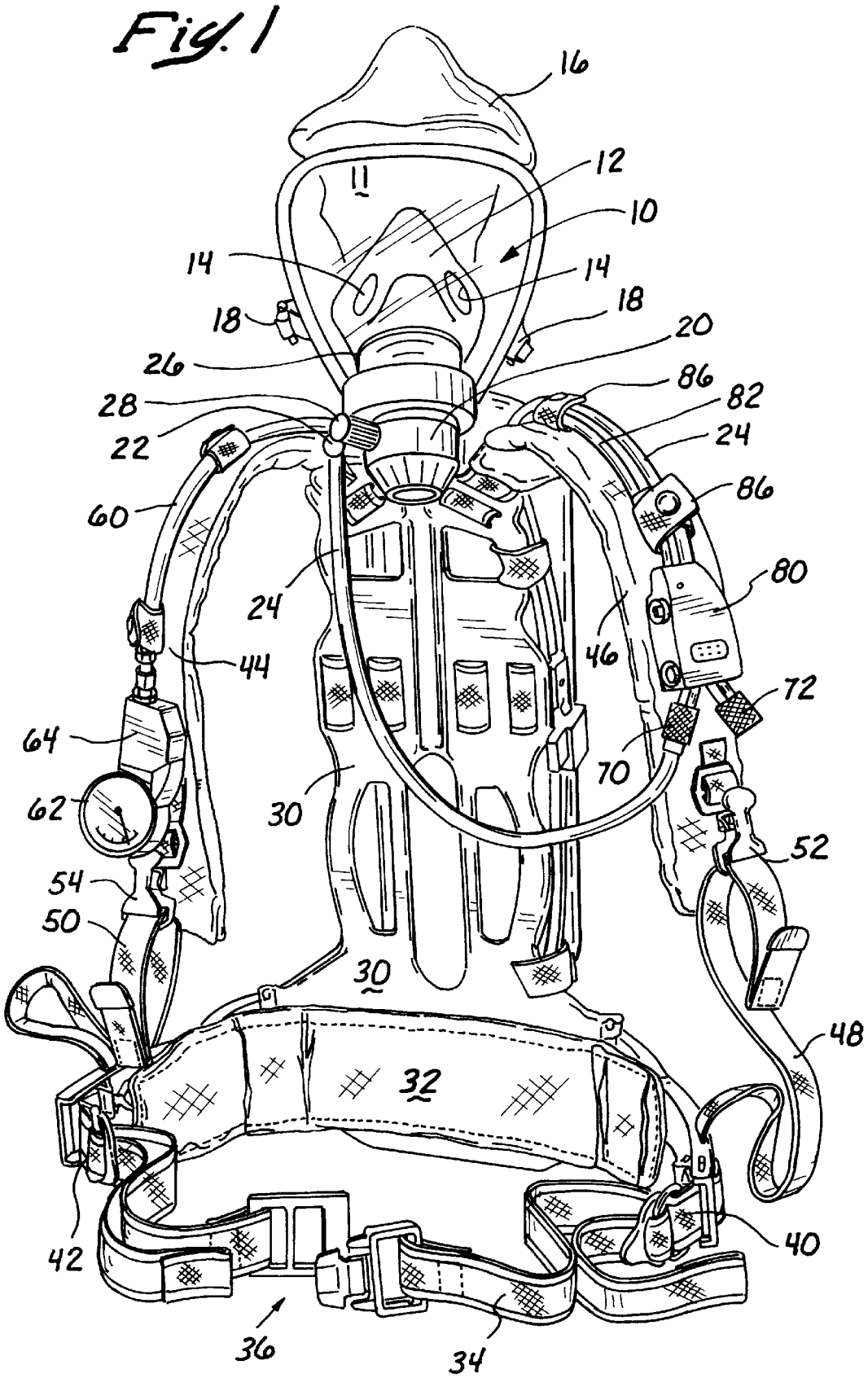
FIG. 1 shows a perspective view of a self-contained breathing apparatus (SCBA) with a personal alert safety system (PASS).
Figure 1A:
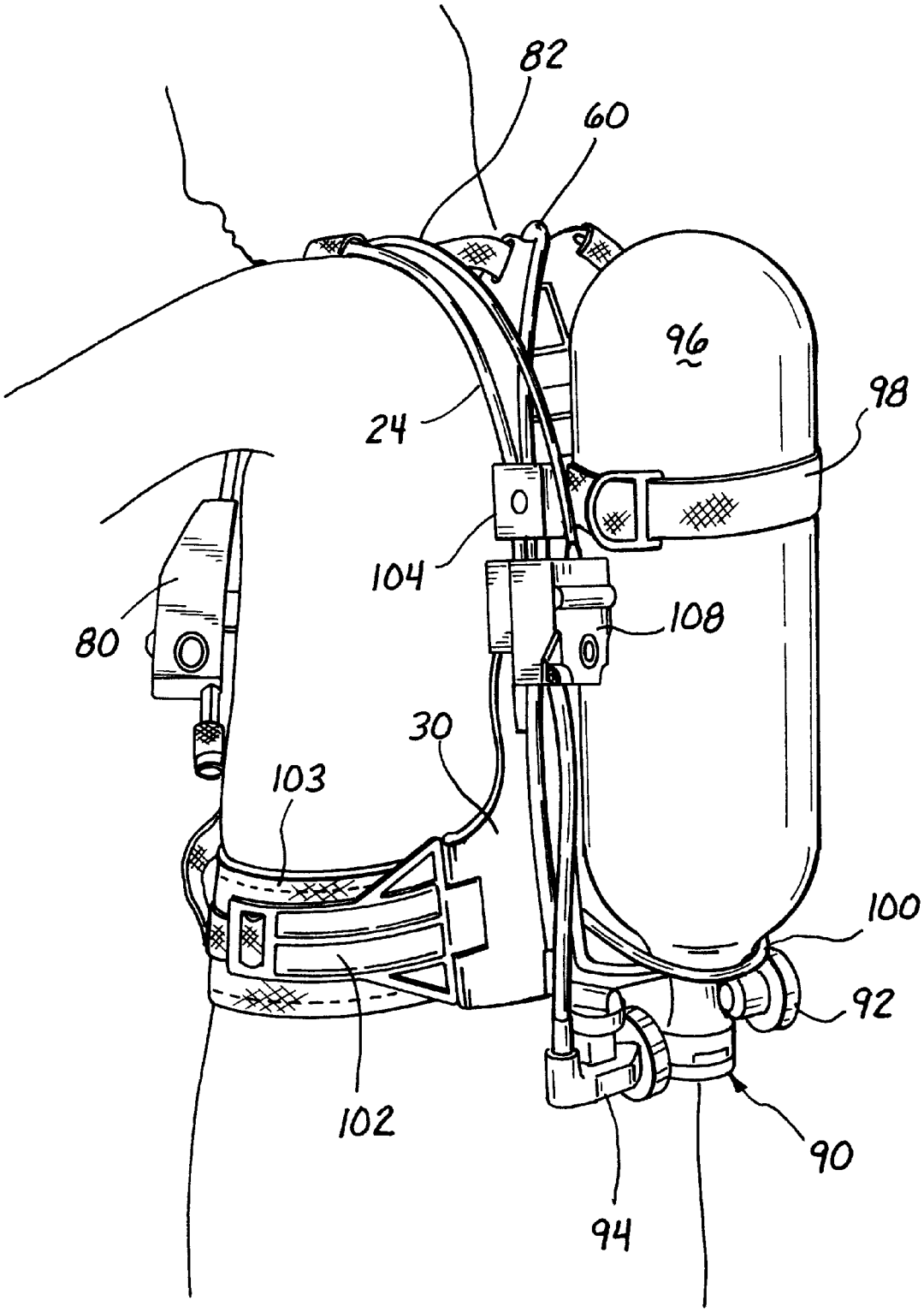
FIG. 1A shows a rear perspective elevation view of the self-contained breathing apparatus PASS, and remote PASS (R-PASS) enunciator.

Looking more specifically at FIGS. 1 and 1A it can be seen that a self-contained breathing apparatus (SCBA) is shown for use by a fireman or emergency worker. The self-contained breathing apparatus (SCBA) is shown having a full face mask 10 with a lens 11 therein. The full face mask 10 incorporates a nose cup or oral nasal mask 12 through which breathing gas can be provided, when air flows through inhalation valves 14 on either side.

The mask 10 is held in place by a head harness 16 and straps connected to connectors 18. The connectors 18 connected to the straps can be attached to a metal or plastic frame that holds the lens 11 of the mask 10 in place.

In order to provide breathing gas, a demand regulator 20 is shown. The demand regulator 20 is provided with an exhaust valve underneath it and a connection 22 to a hose 24 which delivers intermediate pressure breathing gas. The demand regulator or second stage regulator 20 is connected to the mask 10 through a hole or nozzle opening providing a nozzle entrance 26 into the mask area.

In order to allow for a bypass of gas from the second stage regulator 20, a bypass valve is connected to a valve knob 28.

The structure in order to support the SCBA is mounted on a backpack 30. The backpack 30 can be of a body conforming rigid material incorporating a lumbar support 32 surrounding a user's hips in a configuration to allow for comfortable mounting of the backpack 30. A waist belt 34 connects the backpack 30 to a user and is secured by means of a buckle assembly 36 having a loop and connecting tongue or insert.

The belt 34 can be adjusted by adjustment connections 40 and 42 on either side.

In order to secure the backpack 30 to a user, a shoulder harness connection is utilized in the form of padded shoulder harness straps 44 and 46. The padded shoulder harness straps 44 and 46 are in turn secured by adjustable chest straps 48 and 50 that have adjustment means including adjusting buckles which can be in the form of alligator clips 52 and 54.

It is customary to provide for a reading of the amount of gas in a user's tank. In order to do this, a high pressure hose 60 is connected to a high pressure port from the tank or first stage regulator. In turn, the high pressure hose 60 is connected to a gauge 62 which can provide for a reading of the pressure. To facilitate a warning of low pressure, a audible alarm 64 is utilized which will sound when the pressure in the tank drops down to one quarter of the proper tank pressure.

The intermediate pressure hose 24 is shown interconnected to a first connection 70 and a second connection 72. The second connection 72 connected to the first connection 70 forms a Y. The second connection 72 is such where it allows for a supplemental breathing to take place known as buddy breathing in the eventuality another party needs to connect to the intermediate pressure hose when their equipment is inoperative. This is an optional feature of this invention and need not be utilized. However, it has been thought to be quite beneficial in the past and is generally incorporated with equipment of this type.

The personal alert safety system (PASS) is shown with its housing incorporating the PASS 80. Leading from the PASS 80 is a cable harness 82 that provides for communication to the back of the user. In order to secure the cable 82 and the hose 24, snap loops 86 are mounted on the padded shoulder harness 46.

Looking more specifically at FIG. 1A, it can be seen wherein the perspective rear elevation view of the SCBA and associated equipment is shown. In this particular case, it can been seen that the high pressure hose 60 is shown to which the gauge 62 and alarm 64 are connected. The high pressure hose 60 is connected to a high pressure outlet port from a first stage regulator 90. The first stage regulator 90 can be seen incorporating a hand wheel and valve combination 92 and a regulator portion 94. The regulator portion 94 is connected to the intermediate pressure hose or line 24 to provide regulated intermediate pressure to the demand or second stage regulator 20.

In order to service the user of the SCBA a tank of gas 96 is shown strapped to the backpack 30 by means of a tank band 98. The backpack 30 has a backpack cylinder support bracket 100 in the form of a U shaped upstanding member.

In order to provide proper support to the backpack 30, a pair of wings 102 are formed on either side to rest comfortably on the user's waist. To further enhance the support of the backpack 30 a lumbar support 32 is also provided.

A hose retainer block 104 is seen connecting the intermediate pressure hose 24 and the high pressure hose 60 so that they are in a secured position.

The personal alert safety system (PASS) 80 can be seen toward the front of the user. In addition thereto, the remote PASS (R-PASS) enunciator of this invention is shown connected to the signal cable 82 from the PASS 80. This is detailed as R-PASS 108. These particular elements will be detailed hereinafter in the drawings which detail the PASS 80 the R-PASS 108 and the system which allows this invention to function.

Figure 2:
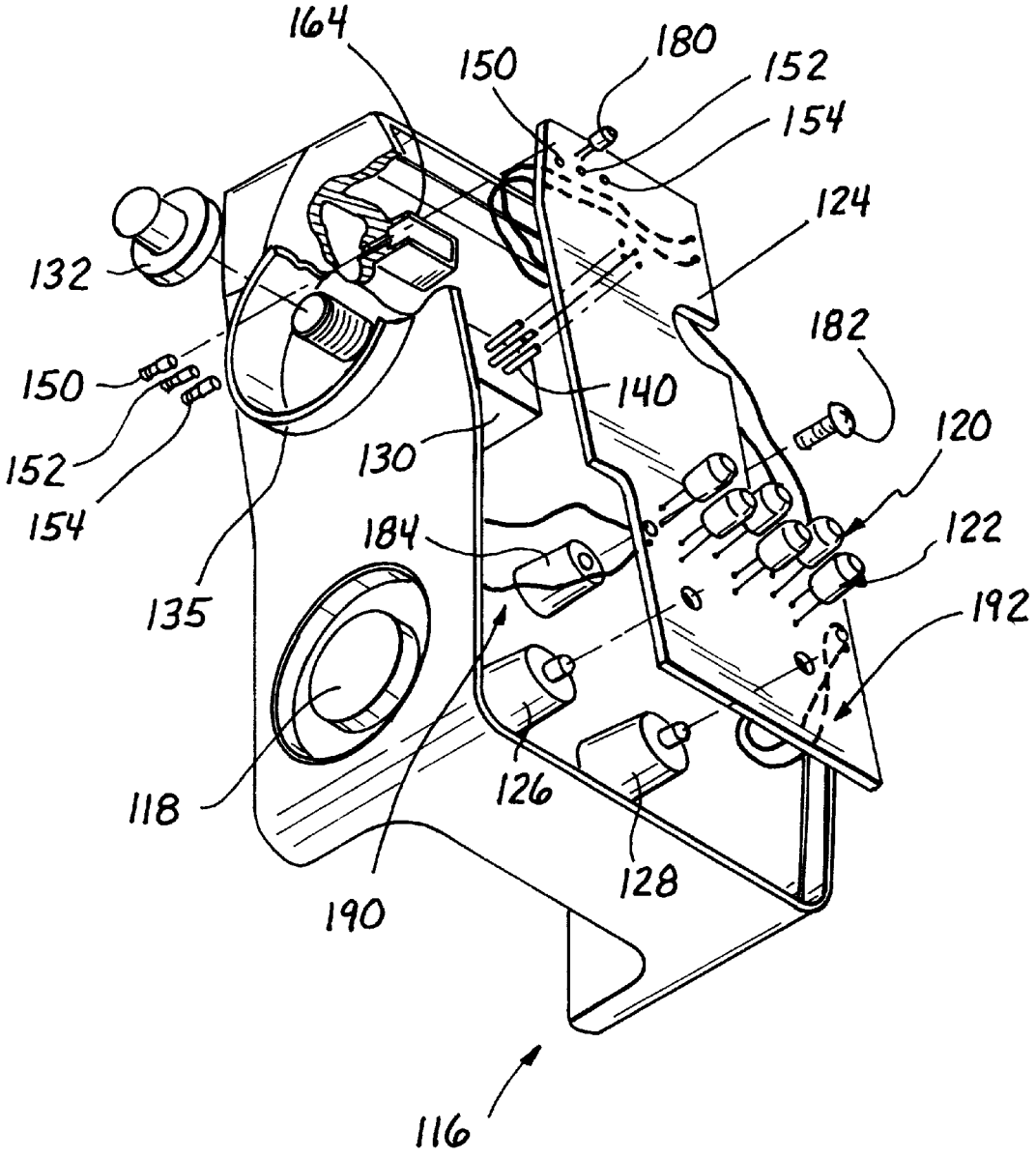
FIG. 2 shows a partially sectioned and exploded perspective view of the PASS.

Looking more particularly at FIGS. 2 through 7, it can be seen wherein the PASS 80 and the R-PASS 108 have been detailed. The PASS 80 in FIG. 2 is shown having a body or housing 116 with a pair of piezoelectric sound generators 118. Each piezoelectric sound generator 118 is on opposite sides in the same location.

The PASS 80 incorporates a bank of light emitting diodes (LED's). Green LED's 120 and red LED's 122 are formed as a bank for warning purposes. The green LED's 120 provide a set of signals which shall be detailed hereinafter, while the red LED's 122 provide alert signals which will also be described hereinafter.

The PASS 80 incorporates a circuit board 124 mounted on mounting bosses 126 and 128. The board 124 has a processor thereon with an appropriate power supply and control functions to allow the PASS 80 and the R-PASS 108 to perform their functions as detailed hereinafter. The PASS 80 has an activator and reset switch module shown as a unit 130. The activation switch button is shown as a button 132 connected to the switch module 130. The button 132 and switch 130 are recessed in a round ring-like shroud 135 to protect against inadvertent activation, and deactivation.

The switch 130 is connected through pins to leads for connection to the circuit board in the form of terminal leads 140. In order to connect the PASS 80 to the R-PASS 108, three terminals 150, 152 and 154 are utilized. These respective terminals 150 through 154 allow for a connection to be made through the cable harness 82 that leads to the R-PASS 108. These terminals can be seen with their matching pins 150, 152 and 154 that are placed in a potting reservoir 164.

Low battery indication is provided through the circuitry and a processor on the board 124 by means of an indicator LED 180. The indicator LED 180 is connected to the board in a manner whereby a signal is created whenever there is a low battery.

In order to further mount the board 124 in the housing 116, a screw 182 is utilized in conjunction with a threaded mounting boss 184.

The function of the green LED's 120 is such wherein the green LED's provide a readout for a scan or sensing mode. When a mercury tilt switch is indicated as being in an inactive mode by the processor, such that the fireman or worker is not moving for twenty three seconds or any particularly desired time, this motionless position creates a signal of the red LED's 122 and the green LED's 120. These functional aspects will be detailed hereinafter in greater detail as set forth in the logic diagrams.

Figure 3:
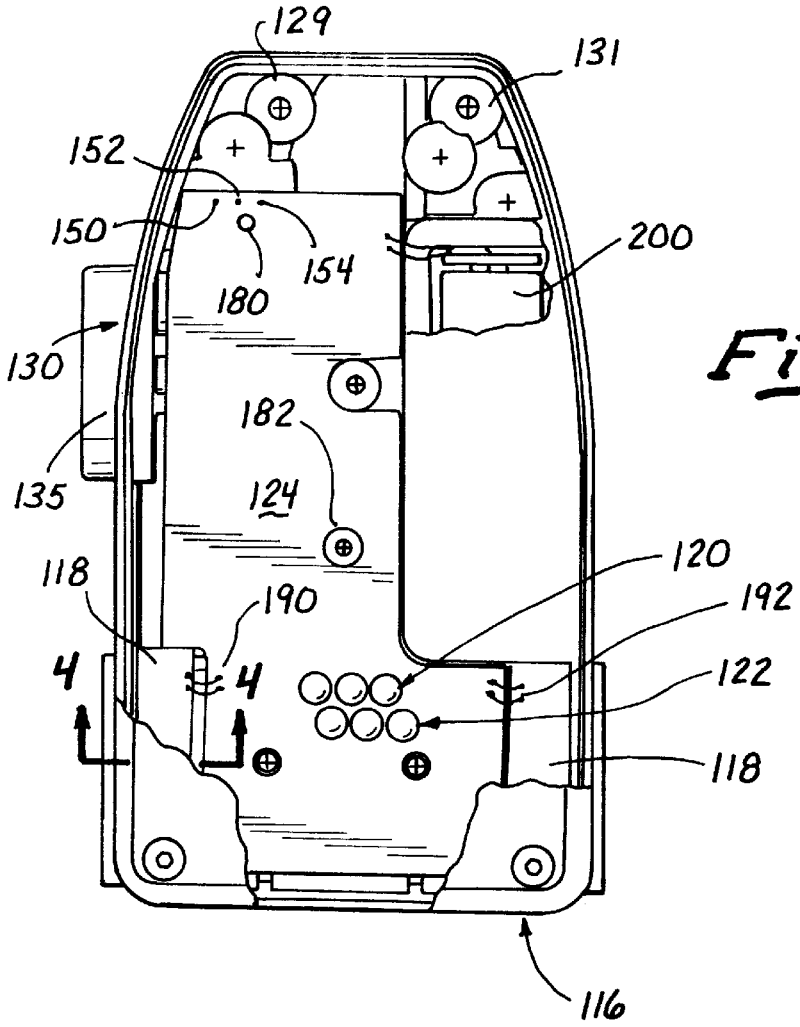
FIG. 3 shows a partially fragmented plan view of the PASS.
Figure 4:
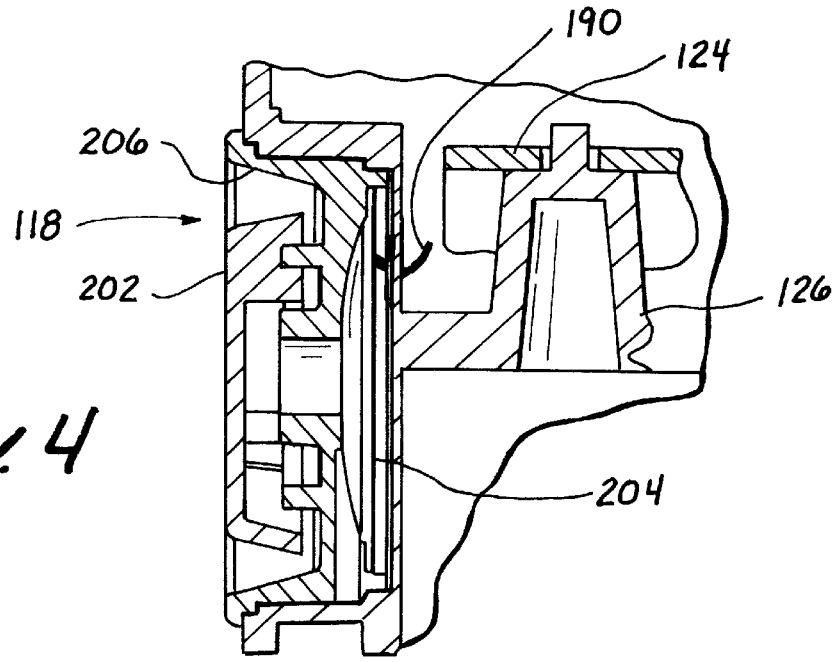
FIG. 4 shows a sectional view of the sounding or alarm mechanism along lines 4—4 of FIG. 3.

Looking more particularly at FIGS. 3 and 4, it can be seen wherein the housing 116 is shown.

Looking at FIG. 3 it can be seen wherein the housing 116 incorporates the piezoelectric sounders 118 on either side and a phantom showing of the green LED's 120 and red LED's 122. Connection wires 190 and 192 are shown connected to the piezoelectric sounders 118 from the circuit board 124. The switch mounting is also seen in the form of a switch generally as switch 130 with its respective mounting flange or shroud 135 therearound. Mounting posts for the circuit board 124, namely posts 126 and 128 are utilized. Holes 129 and 131, are for the cover.

A nine volt battery or other suitable power source 200 is shown within the battery case.

Looking more particularly at FIG. 4 it can be seen wherein the piezoelectric alert sounder 118 has been shown sectioned from lines 4—4 of FIG. 3. The piezoelectric sounder 118 incorporates a cover 202, a piezoelectric element 204 with a retention disk and cover 206. As can be seen in the section, the mounting boss 126 is shown in conjunction with the circuit board 124 having leads 190 leading from the board 124 to the sounding element 204.

Figure 5:
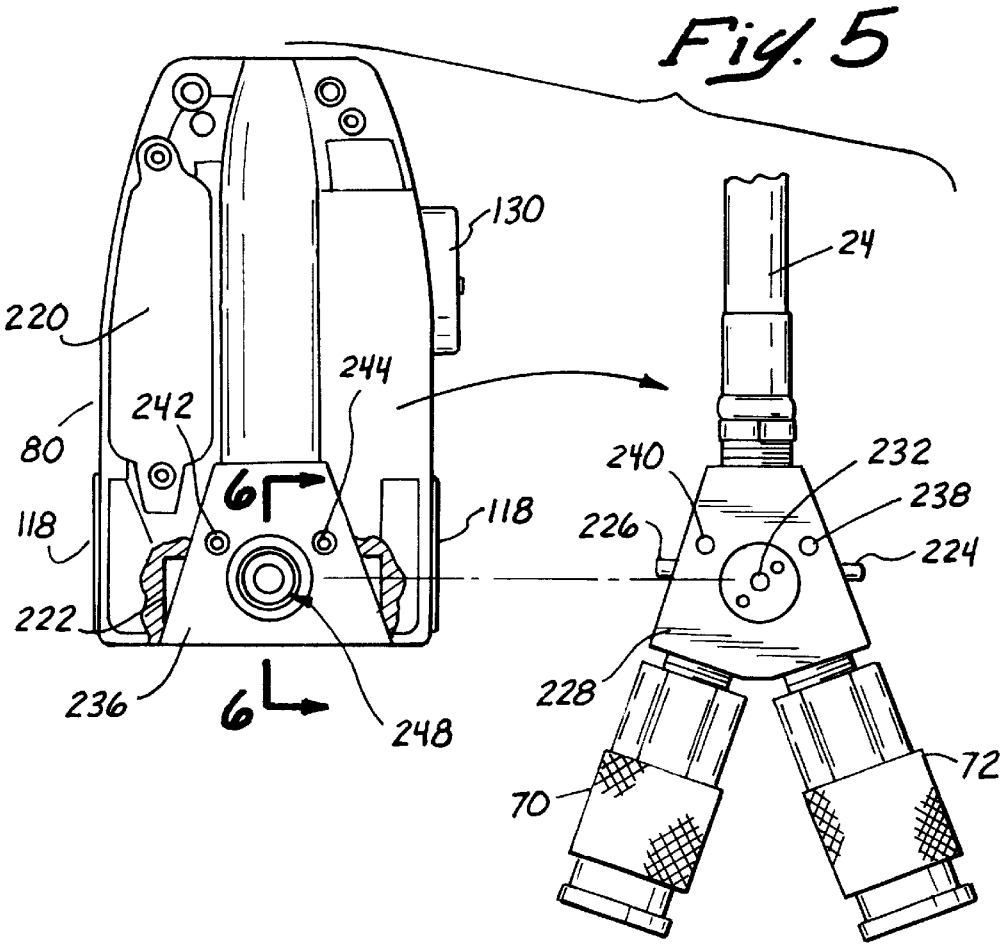
FIG. 5 shows a back plan view of the PASS and the accompanying intermediate pressure hose and fixture upon which it is fitted.
Figure 6:
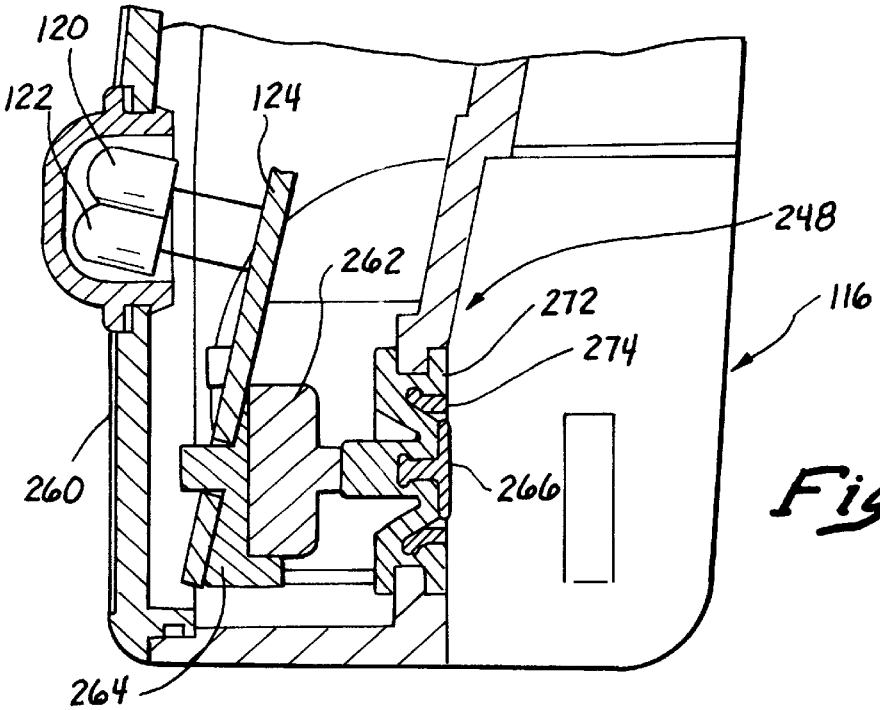
FIG. 6 shows a sectional view in the direction of lines 6—6 of FIG. 5 detailing the actuation mechanism shown in FIG. 5.

FIGS. 5 and 6 show the PASS 80 where it is activated by the intermediate pressure hose 24. Looking at the PASS 80, it can be seen wherein the piezoelectric sounders or actuators 118 are shown along with a battery door or cover 220. The PASS 80 incorporates a slot 222 which receives pins in the form of alignment pins 224 and 226 on either side of a PASS connection fixture, manifold, or multiple passage housing 228.

The fixture 228 is fundamentally a Y connection. The Y connection is such wherein it incorporates the coupler to the second stage or demand regulator 20 in the form of the coupler or connection 70. Connection 72 is also interconnected to the intermediate pressure hose 24 but is only utilized for an optional breathing system for a person requiring it other than the actual user of the SCBA. This is called buddy breathing and is known in the art for providing supplemental breathing to a user of an SCBA whose unit has either lost breathing gas or is somewhat inoperative.

In order to mount the PASS 80 on the fixture 228 and actuate it, a poppet 232 is utilized which only functions upon pressure through the hose 24 being sensed which raises the poppet. The position of the poppet 232 is in the down position until pressure is sensed in the intermediate pressure hose 24 to raise the poppet upwardly and provide a plunger effect.

In order to align and mount the fixture 228, the alignment pins 224 and 226 are received in the slot 222. A truncated pyramidal space 236 receives the Y of the fixture 228 therein. Mounting holes 238 and 240 provide for alignment with pins 244 and 242 respectively received therein so that the truncated pyramidal space 236 is received over the Y or PASS 80 mounting fixture, manifold, or multiple passage housing 228.

When pressure is sensed through the line 24, it raises the poppet 232 which drives a piston 248 of a switch 262 into an actuation mode. The switch 262 with the accompanying piston 248 is mounted on the circuit board as detailed in FIG. 6.

FIG. 6 shows the circuit board 124 with the respective green and red LED's 120 and 122. The cover of the PASS 80 of the housing is shown as cover 260.

The self-contained switch 262 is shown connected to angular alignment spacer 264. The piston function of switch 262 is provided by a button 266 which comprises in part the piston 248 mounted in the housing of the PASS 80 namely housing 116. In this manner, the button 266 is able to drive inwardly against the switch 262 and activate the logic on the circuit board. This is fundamentally done by the button 266 receiving the mechanical movement of the poppet 238.

A flexible mounting membrane 272 is used to mount the switch button 266 therein while the retaining ring 274 helps to secure the button and membrane 266 and 272 into a position for actuating the switch 262. When this actuation takes place under the pressure of the intermediate pressure hose 24, the system becomes functional and is controlled by the logic in the processor in conjunction with the switch 130. It should be noted that the processor can include the various memory and logic switch elements. It can be programmable for various timing functions and multiple and varied alerts and time spans.

Figure 7:
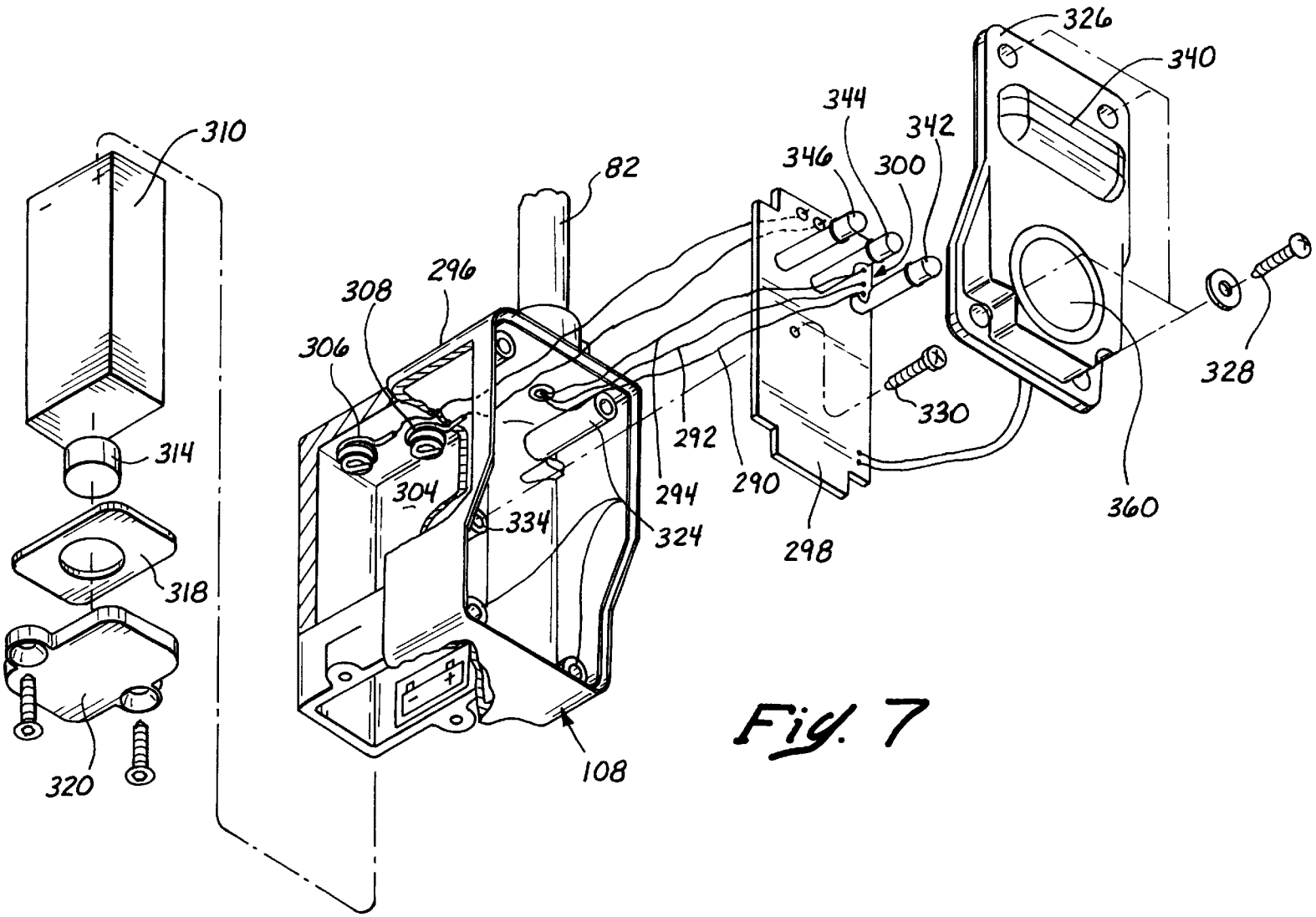
FIG. 7 shows a perspective exploded view of the remote PASS (R-PASS) enunciator.

Looking more particularly at FIG. 7, the remote pass enunciator (R-PASS) 108 is shown. The R-PASS 108 incorporates various portions for providing the remote sounding alert system. It is connected to the PASS 80 by means of the signal cable 82. Signal cable 82 provides for the control by the PASS 80 and actuation in a remote and slaved relationship.

The leads of the cable 82 are such wherein they provide ground, power, and a signal through connector wires 290, 292 and 294. These wires 290, 292, and 294 are brought through a housing 296 connected to the cable 82. These leads are in turn connected to an R-PASS board 298 at lead points 300. The lead points or terminals 300 interconnect the board 298 to the PASS 80 in a slave relationship.

It should be understood that other communication means for connecting the R-PASS 108 to the PASS 80 can be effected through radio frequency signals with a transmitter in the PASS 80 and a receiver in the R-PASS 108. Also fiber optics can be used through the cable 82 or other types of systems with regard to remote telemetry or transmission from the PASS 80 to the R-PASS 108. The R-PASS 108 although it is shown herein as a slave station to the PASS 80 can be effectively an independent unit like the PASS 80 so that it functions and can be controlled remotely or independently by an emergency worker or fireman. The R-PASS 108 can incorporate all functions as the PASS 80 and operate independently with other R-PASS units.

Within the R-PASS 108 is a battery housing 304 having spring contacts 306 and 308. A battery 310 is provided to power the R-PASS 108. In order to assure contact, a foam or resilient pad 314 shims the battery 310 into place. Also, a gasket 318 is utilized with a cover 320 having screws for securing the battery in place in screw openings on the R-PASS 108.

Here again as in the PASS 80, four mounting studs or bosses 324 are utilized at either corner for receipt of a cover 326 thereover by means of screws having an underlying washer such as screw 328. Also, in order to mount the circuit board 298 a screw 330 can be utilized screwing the board 298 into an opening or boss that can be threaded such as boss 334 in the R-PASS 108.

A lens 340 is shown on the cover 326 which serves to overlay three LED's, namely a red LED 342, an amber LED 344, and a green LED 346. These LED's indicate the various conditions of the R-PASS 108 in its slaved relationship with the PASS 80, or if desired in an independent mode.

In the pre-alert and scan mode, the green LED 346 flashes. When there is a low battery, the amber LED 344 flashes. When a warning is to take place, the red LED 342 flashes.

Connected to the circuitry on the board 298 and the power is a piezoelectric sounder or alarm 360 that is integral with the cover.

Fundamentally, the R-PASS 108 serves a slave function as will be seen in the schematic diagram to apprise the user of the conditions of the PASS 80 and R-PASS 108. It also provides supplemental protection in case the PASS is covered up and muffled by virtue of the user facing downwardly.

Figure 8:
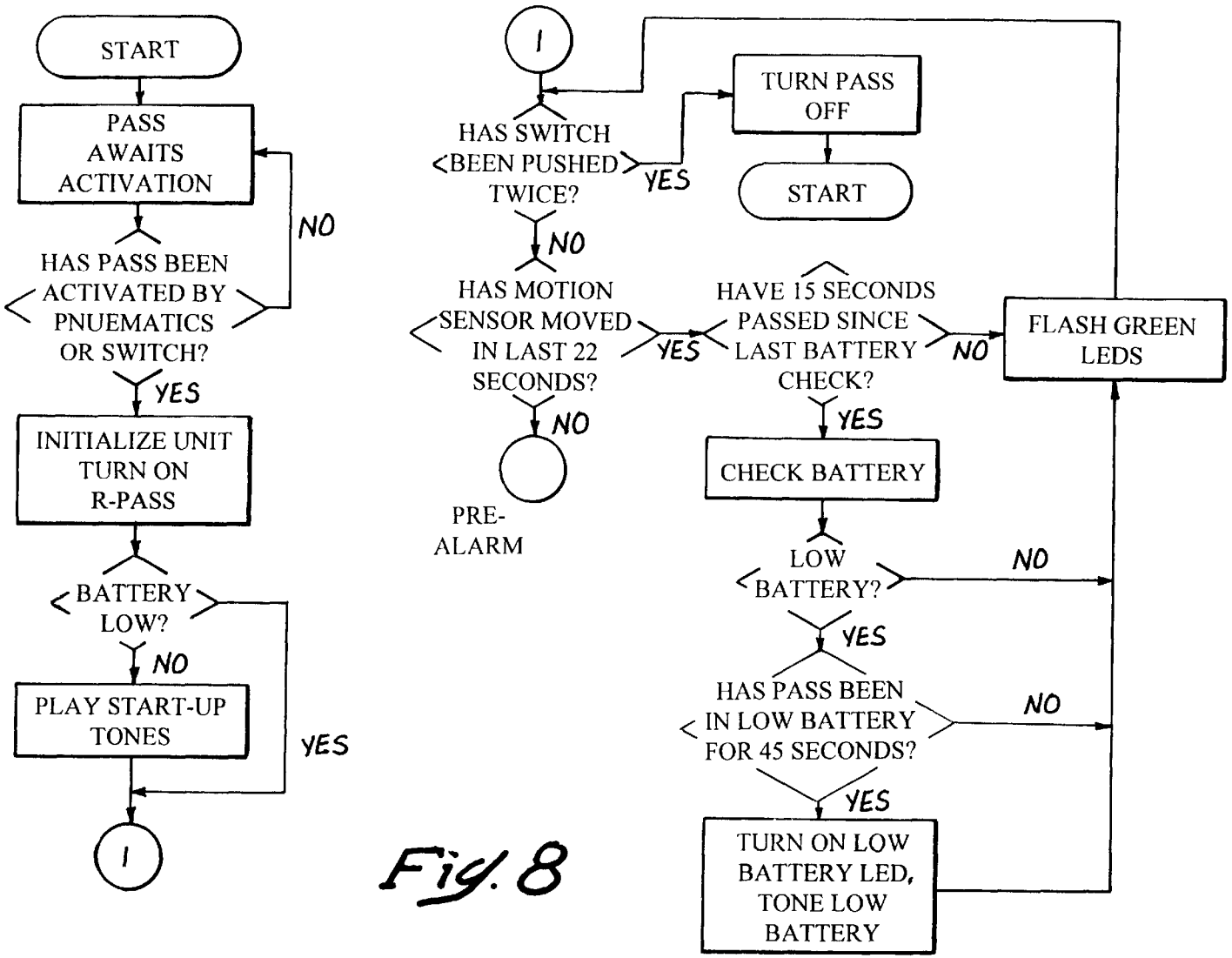
FIG. 8 shows a logic diagram of the operation of the PASS in conjunction with FIG. 9.
Figure 9:
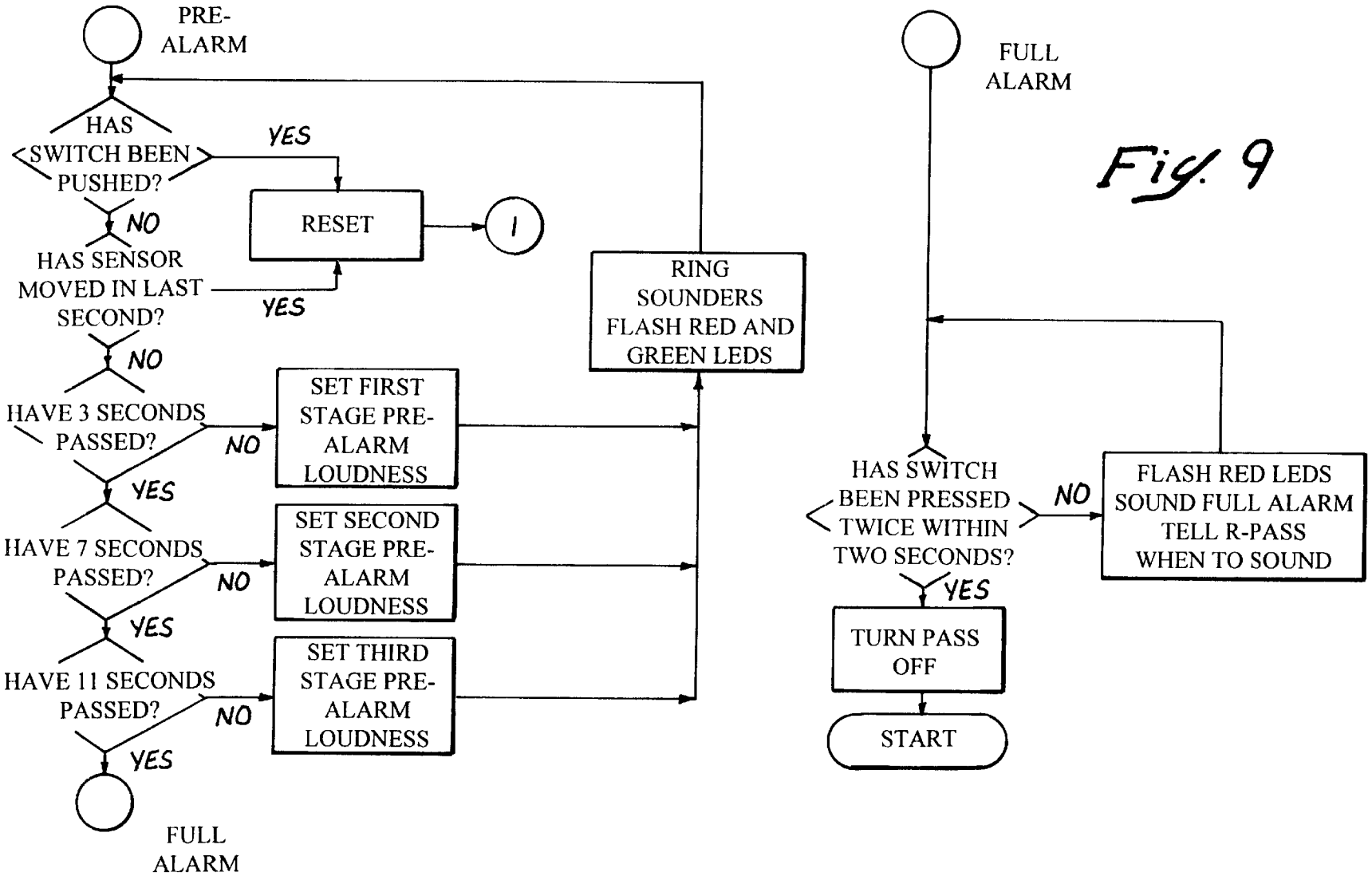
FIG. 9 is a diagrammatic continuation of FIG. 8.
Figure 10:
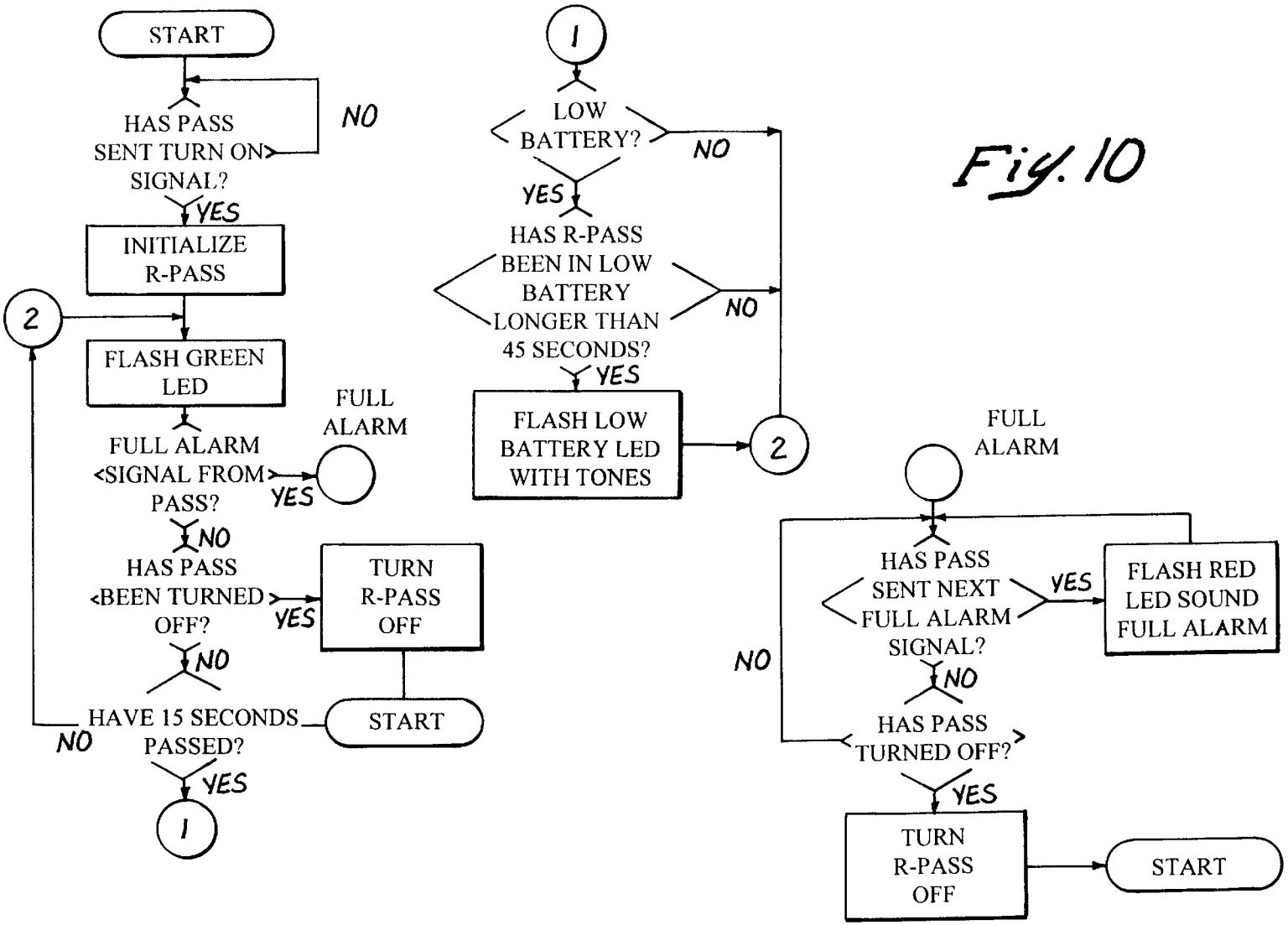
FIG. 10 shows the R-PASS enunciator logic diagram and function in connection with the PASS.

Looking more particularly at FIGS. 8, 9, and 10, it can be seen wherein the flow in a block diagram of the logic of the circuitry sets forth the functions. The system starts by activating the PASS 80 by the pneumatic aspects of the pressure in the intermediate pressure hose 24 pushing the poppet 232 and switch 262 into an activated mode. In effect, the PASS 80 awaits activation by the pneumatic drive of the poppet 232.

If the PASS 80 has been activated, it initializes and turns on the R-PASS 108. A query is also made as to whether there is a low battery. If not, the PASS 80 plays up a start-up tone or tones to indicate that it is an operative mode. The tones can be of various types and duration and can be programmed in the processor on the board 124.

As can be seen in FIG. 8, the system is such wherein after the unit has been activated there is a query as to whether the switch 130 has been pushed twice. If so, the PASS 80 will be turned off and be initialized at the start position.

If the switch 130 has not been pushed twice, the motion detector or mercury switch will be in an activated condition wherein its movement will be monitored. If there has not been movement of the mercury switch for 22 seconds or any other prescribed period of time, a pre-alarm will sound. This pre-alarm as can be seen with regard to FIG. 9 moves the PASS 80 to the next highest level of monitoring and alerting a user.

It should be understood that various motion detectors other than mercury switches can be used. Various tones and warnings in the form of audible tones can be utilized at various levels of activation. Also any input signal other than a pushing twice of the switch 130 can be utilized. For instance an analog level potentiometric switching system can be used or any momentary switch utilizing various switch modes. This can all depend upon the signals generated and input to the logic and program of the processor on the circuit board 124.

In the event that fifteen seconds have elapsed since the last battery check, the battery will then be checked and if not or any other prescribed period of time other than fifteen seconds, the green LED's 120 will flash. In the event the fifteen seconds have passed, the battery will be checked and a determination made as to whether a low battery has been encountered. If there is no low battery, the green LED's 120 will flash.

If there is a low battery condition a determination will be made as to whether or not the PASS 80 has been in a low battery condition for forty five seconds. If not, a continuation of the flashing of the green LED's 120 will take place. If the battery has been in a low battery condition for forty five seconds there will be a low battery light turned on, namely low battery light 180. A specific tone that is low or modulated in sound with regard to the battery will also emanate.

As can be seen from the foregoing, the PASS 80 without movement is then placed in the pre-alarm state as indicated in FIG. 9. When the pre-alarm state has been established, a query is made as to whether the switch 130 has been pushed. If switch 130 has been pushed, the system will reset and go back to 1 of FIG. 8. If the switch 130 has not been pushed, a determination will be made as to whether the sensor or mercury switch has moved within the last second. If it has, the unit will then reset again and go back to 1.

In the event the sensor has not moved in the last second, a query will be made as to whether or not three seconds have elapsed. If not, it will set the first stage pre-alarm loudness. In this pre-alarm tone mode, the piezoelectric sounders 118 will sound and the red LED's 122 and green LED's 120 will flash alternately to give a mixed red and green signal. The tone can be a specific pre-alarm tone, or loudness related to the first stage of the pre-alarm. This can also be modified by programming the processor on the board 124.

If three seconds have elapsed or passed a seven second query is made. If seven seconds have passed the PASS 80 will set a second stage pre-alarm signal so that the relative loudness will increase. Also a different alternative tone or frequency can be used as the second stage pre-alarm. If seven seconds have passed a query will be made as to whether or not eleven seconds have passed. If not, a third stage pre-alarm loudness or different tone will be set to ring the sounders and flash the red and green LED's respectively 122 and 120 with the third stage pre-alarm sound or louder tone.

If eleven seconds have elapsed thereafter, a full alert alarm will be activated with a full alarm sound. All of the previous alarms and sounds, namely the first stage pre-alarm relative loudness or different tones with the red and green LED's respectively 122 and 120 flashing and the second stage pre-alarm loudness or tone and third stage pre-alarm loudness or tone conditions escalate or can vary in sound. Such tones can be lower tones, higher tones, or such tones as the well known high-low tone, wail tone, or claxon like tone. Such tones and levels have been established for emergency alarms. Such tones as a rising wail, a beep, a constant staccato tone, or any other type of tone incrementing upwardly or differently and creating a first, second, and third stage alarm that is recognizable with regard to its audio characteristics can be created and utilized at the various stages.

When the full alarm has been set, the system then makes a determination as to whether or not switch 130 has been pressed twice within two seconds. If it has been, this indicates that the emergency worker or fireman is responsive and it turns the PASS 80 off and goes back to start mode. In effect, it has a monitoring function on the worker or fireman to allow the worker or fireman to cancel the alarm by pressing the switch 130 twice. Any switch increment can be utilized for the manual switching of this invention.

If the switch 130 has not been pressed twice, or in any other pre-established sequence, the full alarm will be actuated with the red LED's 122 flashing. The signal will then be transmitted to the R-PASS 108 alarm which will then sound in a slaved manner, being driven by its own battery as far as its separate piezoelectric sounder is concerned. In effect, the R-PASS 108 effectively causes the sounding of the full alarm in a second location. However, as can be understood it can also be placed in parallel sequence with regard to the various functions of the PASS 80 so that it sounds signals in tandem with the PASS 80. This would create a situation wherein the PASS 80 and R-PASS 108 would create alarm signals which are tantamount to simultaneously sounding alarms in tandem with each other. Also, multiple locations and multiple R-PASS units 108 can be utilized rather than the single one mounted solely on the back of a user.

Looking more particularly at FIG. 10, it can be seen wherein the R-PASS 108 has been started with a signal through the respective lines in the cable 82. At the start junction, a query is made as to whether or not the PASS 80 has sent a turn on signal to the R-PASS 108. If not, it goes back to its start mode. In the eventuality the PASS 80 has sent a turn on signal, the R-PASS 108 is initialized and flashes its green LED 346.

The next mode is such that if a full alarm signal from the PASS 80 is received, the R-PASS 108 will go into its full alarm mode. If not, a query will be asked as to whether or not the PASS 80 has been turned off. If so, the R-PASS 108 will then be turned off and it will then be placed in the start mode. However, if it has not been turned off, and fifteen seconds have elapsed or passed, it will continue in its mode. If fifteen seconds have not passed the system will go back to position 2 to flash the green LED 346.

At position 1, a low battery query is undertaken as to the R-PASS 108. If no low battery is sensed, it will revert back to position 2. However, if the R-PASS 108 has been in a low battery state longer than forty five seconds it will then flash a low battery tonal signal, and the amber LED 344. This low battery signal can be in various tones as to whatever a particular designer cares to provide for a discrete, differentiated, or higher low battery tone from the R-PASS 108.

In the full alarm mode, a query is made as to whether or not PASS 80 has sent the next full alarm signal. If not, the query is made as to whether or not the PASS 80 is turned off. If it has not turned off, it will maintain the full alarm mode in the R-PASS 108. Also to this extent, if the PASS 80 has sent the next full alarm signal, coincident with this, is the flashing of the red LED 342 with the full alarm signal.

If the PASS 80 has turned off, the R-PASS 108 will then turn off and it will then be placed in the start position again.

As a consequence, it can be seen that the R-PASS 108 incorporates a slave function with separate low battery signals and provision of a full alarm based upon the PASS 80 providing a signal through the cable 82. As previously stated, other modes of communication to the R-PASS 108 can be effected and it is not necessary to have a hard wired cable.

It should be further understood, that multiple R-PASS's can be used at other body locations. Also, the R-PASS can be substituted or embellished with signals in the user's mask or other locations to provide an appropriate online signal. In effect, a signal can be slaved from the PASS 80 to the user's mask 10 and provided with LED signals so that the user does not have to look down at the PASS 80. Various slaved conditions through cables such as cable 82 can be brought to the attention of the user through the mask and the optical view provided through the lens within the user's, hazardous worker's, or fireman's field of vision. Also, remote sounders can be provided within the mask area as far as warnings.

As a consequence, this invention should be read broadly in light of the prior art and the capability it provides as claimed hereinafter.

What is claimed is:

1. A self-contained breathing apparatus (SCBA) with a personal alert safety system (PASS) comprising:

an SCBA having a tank of breathing gas, a first stage regulator, and a second stage regulator connected to said first stage regulator by an intermediate pressure hose;

a PASS which provides a signal based upon a prescribed period of immobility by a user; and, a remote personal alert safety system (R-PASS) adapted for mounting on a user at a different location from said PASS and in communication with said PASS for providing a signal removed from the position of said PASS.

2. The SCBA as claimed in claim 1 wherein:

said communication between said PASS and R-PASS is by a wire connection.

3. The SCBA as claimed in claim 1 wherein:

said communication between said PASS and R-PASS is by radio frequency.

4. The SCBA as claimed in claim 1 wherein:

said communication between said PASS and R-PASS is by a fiber optic cable.

5. The SCBA as claimed in claim 1 further comprising:

a PASS and R-PASS having lighting means to provide a given signal to a user.

6. The SCBA as claimed in claim 1 further comprising:

an audio alert in said PASS and R-PASS.

7. The SCBA as claimed in claim 6 wherein:

said audio alert has multiple stages of varying sounds.

8. A personal alert safety system (PASS) for a user of a self-contained breathing apparatus (SCBA) having a pressurized source of gas comprising:

a PASS having a processor and a source of power;

an audio alarm mounted in said PASS;

a remote personal alert safety system (R-PASS) having a second audio alarm in communication with said PASS and adapted for mounting on a user at a different location from said PASS; and, a signal source from said PASS for communicating to said R-PASS to cause said R-PASS to issue an audio alarm.

9. The PASS as claimed in claim 8 wherein:

said communication is by a wire connection between said PASS and said R-PASS.

10. The PASS as claimed in claim 8 wherein:

said communication is by a fiber optic cable between said PASS and said R-PASS.

11. The PASS as claimed in claim 8 wherein:

said communication is by a radio frequency communication between said PASS and said R-PASS.

12. The PASS as claimed in claim 8 wherein:

said audio alarm of said R-PASS is in slaved communication to said PASS.

13. The PASS as claimed in claim 8 wherein:

said audio alarm is provided with multiple stages of sound variations.

14. A self-contained breathing apparatus (SCBA) with a personal alert safety system (PASS) comprising:

a tank of breathing gas;

a first stage regulator and a valve connected to said tank of breathing gas;

a mask having a demand regulator connected thereto;

an intermediate pressure hose connected between said first stage regulator and said demand regulator;

a PASS fixture connected to said intermediate pressure hose;

a PASS for mounting on said PASS fixture;

a first audio alarm within said PASS;

a circuit in said PASS which senses movement of a user of said SCBA and sounds said audio alarm after a pre-established time of non-movement of the user;

a remote personal alert safety system (R-PASS) for attachment to a location removed from said PASS;

a communication link for connecting said PASS to said R-PASS for sounding said audio alarm at the removed location and, a pressure driven connection on said PASS fixture for activating said PASS based upon pressure in said intermediate pressure hose.

15. An SCBA as claimed in claim 14 further comprising:

a switch on said PASS for interfacing with said pressure driven connection in order to activate said PASS.

16. An SCBA as claimed in claim 14 wherein:

said communication link is a wire connection.

17. An SCBA as claimed in claim 14 wherein:

said communication link is a fiber optic connection.

18. An SCBA as claimed in claim 14 wherein:

said pre-established time for said audio alarm is preceded by at least one prior warning signal.

19. An SCBA as claimed in claim 18 wherein:

said warning signal is differentiated from said audio alarm by tone or level of sound.

20. An SCBA as claimed in claim 19 further comprising:

a switch for deactivating said audio alarm or prior warning signals.

21. An SCBA as claimed in claim 14 further comprising:

a switch for activating and deactivating said PASS.

* * * * *